US007175769B1

(12) United States Patent
Wall et al.

(10) Patent No.: US 7,175,769 B1
(45) Date of Patent: Feb. 13, 2007

(54) METHOD OF FILTERING DEBRIS FROM REFRIGERANT

(76) Inventors: Thomas M. Wall, 124 Montcastle Ct., Nashville, TN (US) 37221; Daniel D. Green, 3813 Haywood Ct., Nashville, TN (US) 37211

( * ) Notice: Subject to any disclaimer, the term of this patent is extended or adjusted under 35 U.S.C. 154(b) by 142 days.

(21) Appl. No.: 10/764,894

(22) Filed: Jan. 26, 2004

Related U.S. Application Data

(60) Provisional application No. 60/442,312, filed on Jan. 24, 2003.

(51) Int. Cl.
*B01D 35/14* (2006.01)

(52) U.S. Cl. ..... 210/739; 210/741; 210/805

(58) Field of Classification Search ..... 210/130–132, 210/138, 340, 341, 739, 741, 767, 805, DIG. 6, 210/DIG. 7; 62/77, 195, 474
See application file for complete search history.

(56) References Cited

U.S. PATENT DOCUMENTS 3,175,342 A * 3/1965 Balogh ..... 96/132
3,355,021 A * 11/1967 Jones ..... 210/130
4,267,705 A 5/1981 Leonard et al.
4,973,406 A 11/1990 Ponzielli
5,067,327 A 11/1991 Leblanc
5,094,087 A 3/1992 Gramkow
5,247,812 A 9/1993 Keltner
5,269,155 A 12/1993 Adelmann
5,295,367 A 3/1994 Keltner
5,390,503 A 2/1995 Cheng
6,260,372 B1 7/2001 Burke

* cited by examiner

*Primary Examiner*—Matthew O. Savage
(74) *Attorney, Agent, or Firm*—Waddey & Patterson, P.C.; Howard H. Bayless

(57) ABSTRACT

Debris is filtered from refrigerant in a refrigerant system by: (1) installing a filtration apparatus in the high pressure side of a refrigerant system, the apparatus comprising a filtration housing having primary and secondary passages, a primary filter disposed in the primary passage, and a diverter means for selectively directing refrigerant flow through either the primary or the secondary circuit passages; (2) directing refrigerant flow through the primary circuit passage; (3) operating the refrigerant system until a shifting parameter is obtained; and (4) operating the diverter means so as to direct refrigerant flow to the secondary circuit passage. Optionally, a secondary filter is disposed in the secondary filter channel. In alternate methods, the shifting parameter comprises one of: elapsed time of operation of the system; selected differential pressure across the primary filter; or a selected compressor discharge pressure above said normal compressor discharge pressure.

16 Claims, 5 Drawing Sheets

METHOD OF FILTERING DEBRIS FROM REFRIGERANT

This application claims benefit of Provisional U.S. Patent Application Ser. No. 60/442,312, filed Jan. 24, 2003, entitled "Post Component Failure Filtration Apparatus for Automotive Air-Conditioning Systems" which is hereby incorporated by reference.

BACKGROUND OF THE INVENTION

The present invention relates generally to the field of automotive air-conditioning systems and, more particularly, to automotive air-conditioning refrigerant systems.

For illustration, FIG. 1 is a refrigerant flow diagram showing the major components of a conventional automotive air-conditioning refrigerant system 100 having a compressor 104, a condenser 105, an orifice tube 106 (or other similar limited flow pressure reducer), and an evaporator 108. Refrigerant 102 flows through the air-conditioning refrigerant system 100 in directions shown by refrigerant flow direction arrows 101. The air-conditioning refrigerant system 100 is subdivided into a system high-pressure side 110 and a low pressure side 112 as shown.

As illustrated in FIG. 2, a common mode of initial internal failure of current automotive air-conditioning refrigerant systems 100 is the catastrophic failure of an Original Equipment Manufacturer ("OEM") component that was installed at the time of manufacture of the vehicle. In particular, OEM compressors 104 are susceptible to catastrophic failure of those component compressor parts internal to the flow boundaries of the air-conditioning refrigerant system 100. These component parts, such as compressor impellers, may fracture and introduce bits of solid debris 116 of various sizes into the air-conditioning refrigerant system 100. Regardless of the reason for the initial compressor 104 failure, catastrophic or non-catastrophic, it is probable that some debris 116 will be introduced into the air-conditioning refrigerant system 100 either during the failure itself or during the subsequent replacement of the compressor 104.

One of the major problems frequently encountered by mechanics engaged in the repair of an automotive air conditioning refrigerant system is the removal of such debris 116 from the air-conditioning refrigerant system 100. Repair or replacement of the OEM compressor 104, even with an OEM approved replacement, without the removal of substantially all the debris 116 created by the failure may cause reduced performance of the repaired air-conditioning refrigerant system 100 or even post-repair damage or failure of the replacement compressor 104. Various post-repair problems that may be caused by debris 116 include:

(1) reduced refrigerant flow resulting in excessively high pressures;

(2) an increase in refrigerant temperature caused by excessively high pressures;

(3) reduced compressor lubrication due to reduced refrigerant flow;

(4) excessive heating of compressor due to reduced refrigerant flow;

(5) excessive heating of compressor due to reduced lubrication; and (6) physical damage to compressor components Regardless of the reason for the initial compressor internal failure, some debris 116 will accumulate in the air-conditioning refrigerant system 100. Referring to FIG. 1, the direction of flow 101 of the refrigerant during normal operations is shown. Starting at the compressor 104, refrigerant 102 flows from the compressor discharge, through the condenser 105, and into the inlet of the orifice tube 106. This portion of the air-conditioning refrigerant system 100 is designated the high pressure side 110. Refrigerant pressure at the compressor discharge is typically between about 80 p.s.i.g. and about 200 p.s.i.g. and drops little until the refrigerant 102 flows through the orifice in the orifice tube 106. From the orifice tube outlet, refrigerant 102 flows through the evaporator 108 and into the compressor suction. Refrigerant pressure at the orifice tube outlet is typically around 45 p.s.i.g. and drops to 30 p.s.i.g. as the refrigerant 102 flows into the compressor suction. This portion of the air-conditioning refrigerant system 100 is designated the low pressure side 112. The air-conditioning refrigerant system 100 may have other components, such as an accumulator and/or drier that are not shown.

Referring now to FIGS. 1 and 2, as a compressor 104 begins to fail and emit debris 116, normal refrigerant flow 101 will introduce debris 116 into the high pressure side 110 and in particular, into the compressor discharge line. Immediately following major internal compressor failure, it is likely that the pressure differential between the high pressure side 10 and the low pressure side 112 will result in reverse flow through the compressor 104. Thus, it is likely that some of the debris 116 will be introduced into the low pressure side 112, and in particular, into the compressor suction line. A major internal compressor failure can cause some of the debris 116 to be carried by the refrigerant 102 throughout the refrigerant system and into all major air-conditioning refrigerant system components.

Compressors 104 are designed to pass debris 116 up to a certain size without damage to the compressor 104. Debris 116 above this size can damage the compressor 104 and sometimes cause complete failure of the compressor 104. As mentioned above, debris 116 can sometimes be found in all parts of the air-conditioning refrigerant system 100 after a component failure. Because of this possibility, a suction filter (not shown) should be installed at the compressor suction. Suction filters are usually designed with a filter mesh of 40 to 60, which will trap debris 116 of about 300 microns or larger. Some of the debris 116 which is small enough to pass through the compressor 104 may accumulate in the orifice tube 106 and cause reduced refrigerant flow.

The nature of the debris 116 released by a component failure depends on various factors, including: the particular system design, the composition of the failed parts, the type of failure encountered and the temperatures generated during failure. For instance, in the air-conditioning refrigerant system 100 of some makes of vehicles, debris 116 dissolved in the high temperature refrigerant fluid 102 discharged from the compressor 104 can accumulate as a solid or as sludge in the condenser 105 where the refrigerant 102 is rapidly cooled. In removing such debris 116, it is often necessary to apply heat to the condenser 104 before the debris 116 can be flushed from the system 100. There are numerous modes of failure and manner and location of debris 116 contamination.

Currently, there are several different conventional methods used to remove debris from the various air-conditioning refrigerant systems following component failure and replacement. One method is to blow out the air-conditioning refrigerant system with compressed air. Manufacturers do not recommend this method because of a possible hazard created when 134a refrigerant is combined with air under pressure. Also, the compressed air method is not a very effective method for removing debris from an air-conditioning refrigerant system.

Another method is to flow a flushing solvent under pressure through the air-conditioning refrigerant system to flush out the debris. This method requires the use of specialized flushing equipment that can currently cost from one hundred to several thousand dollars. Besides the expense of specialized equipment, the method requires a single use flushing solvent and specialized disposal methods for the contaminated flushing solvent. The flushing solvent and its disposal represent significant expense and environmental hazard. Although conventional flushing will remove most of the debris from an air-conditioning refrigerant system, it will not remove the debris which has solidified in the condenser. Also conventional flushing will not remove debris that is trapped between the refrigerant system hose connections and the refrigerant system hose material, or debris that has become embedded in the refrigerant system hose material. Moreover, incomplete removal of the flushing solvent can dilute the refrigerant oil. Dilution of the refrigerant oil can result in inadequate lubrication of the replacement compressor. This may cause premature failure of the replacement compressor.

Some mechanics simply replace all or almost all of the air-conditioning refrigerant system components that could contain debris. This method has the disadvantage of being expensive and labor intensive. Also, unless all of the components are replaced, the possibility still exists that some debris could remain in the air-conditioning refrigerant system and cause post repair failure or reduced performance.

A fourth method is to install an inline filter between the condenser and the orifice tube after installing a replacement compressor or other replacement component. This method will normally prevent debris from accumulating in the orifice tube. However, if significant amounts of debris were present following repair and then became trapped in the inline filter, the filtered debris may clog the filter. A clogged inline filter would block or partially block the flow of refrigerant. Such a reduction in refrigerant flow could cause the post repair problems mentioned above. Also, this method does not remove any debris that could be in the low pressure side of the air-conditioning refrigerant system.

A similar method is to install an inline filter in the low pressure side of the system, usually as near as possible to the compressor suction. One of the larger Original Equipment Manufacturers recommends this as part of all air-conditioning refrigerant system repair procedures whenever a compressor has been replaced. Although this would prevent any damaging debris from entering the compressor, this method does not remove any debris that could be in the high pressure side of the air-conditioning refrigerant system. Thus, this method should be combined with some other procedure designed to prevent debris from reducing the refrigerant flow in the high pressure side of the air-conditioning refrigerant system.

An alternative method is a flushing procedure commonly termed a 'live flush' and is frequently used to flush solid debris from the condenser. A 'live flush' normally requires the installation of a disposable filter in the liquid portion of the high pressure side of the air-conditioning refrigerant system, between the condenser and the orifice tube. After the repairs have been completed, the air-conditioning refrigerant system is operated for some period of time to allow the refrigerant to reach operating temperature. At operating temperature, the refrigerant dissolves the solid debris in the condenser and the debris is then trapped by the inline filter. After some period of time, usually about 1 hour, the air-conditioning refrigerant system is shut down. Next, the refrigerant and then the disposable inline filter are removed. Finally, the air-conditioning refrigerant system is recharged with refrigerant. Although this method removes any debris from the high pressure side, the compressor is not protected from potential damage caused by debris in the low pressure side. The additional labor time represent significant expense. Additionally, the replacement and disposal of the flushing refrigerant, and the use and disposal of the inline filter represent additional environmental impact and disposal costs.

Unfortunately, the Original Equipment Manufacturers are not in agreement as to which procedure or combination of procedures to recommend for the removal of debris. Until recently, one of the major Original Equipment Manufacturer did not recommend flushing as a way to remove debris from the system. They instead recommended the installation of a filter in the high pressure side of the air-conditioning refrigerant system, preferably between the condenser and the orifice tube. Original Equipment Manufacturer now recommends flushing after the repair of any major air-conditioning refrigerant system failure, but only with 134a refrigerant. While that Original Equipment Manufacturer continues to recommend installation of a filter in the high pressure side of the air-conditioning refrigerant system between the condenser and the orifice tube, they also recommend installation of an additional filter in the low pressure side of the air-conditioning refrigerant system 100 near the compressor suction.

While most Original Equipment Manufacturers and compressor re-builders recommend flushing an automotive air-conditioning system as a way to remove debris from the system, there is no agreement as to the optimal procedure. Examination of the various methods for flushing an automotive air-conditioning refrigerant system reveals several key steps that most of the Original Equipment Manufacturers and compressor re-builders would agree upon:

(1) loose and lightly adhered debris should be removed from the refrigerant system;

(2) the air-conditioning refrigerant system should be flushed with 134a refrigerant in place of or following a solvent flush to eliminate some of the problems associated with incomplete removal of flushing liquid;

(3) heat the flushing agent to increase the possibility of removing more of the debris from the air-conditioning refrigerant system;

(4) install an inline filter in the high pressure side to trap debris not removed by flushing;

(5) ensure that the orifice tube (or expansion valve) remains as clean as possible;

(6) replace the accumulator/drier or the receiver/drier (depending on the system); and (7) install a suction filter in the low pressure side of the air-conditioning refrigerant system to trap debris.

Due to the high cost of automotive air-conditioning repairs and due to potential environmental impact of discarded filters, refrigerant and flushing solvent, it is desirable to remove the debris from the system in a cost effective manner with as little discard of filters, refrigerant and flushing solvent as possible. Each of the methods enumerated above has one or more disadvantage including: limited effectiveness in debris removal and preventing post repair component failure; excessive cost of materials; excessive labor time and labor cost; excessive cost of disposal; and excessive environmental impact upon disposal.

What is needed is a new method and apparatus to remove the debris from the air-conditioning refrigerant system in a time saving, cost effective manner with as little discard of filters, refrigerant and flushing solvent as possible.

SUMMARY OF THE INVENTION

In one embodiment of this invention, an apparatus and method of refrigerant flushing includes a fluid filtration apparatus having a primary circuit for flowing refrigerant fluid through a primary filter during debris flushing of an automotive air-conditioning refrigerant system. After a failed component is replaced, the fluid filtration apparatus is installed in the high pressure side of the air-conditioning refrigerant system between the condenser and the orifice tube. The air-conditioning refrigerant system is charged with refrigerant and operated at normal temperature to dissolve and flush any debris in the high pressure side. The primary filter traps any such debris.

The fluid filtration apparatus also has secondary circuit for flowing refrigerant fluid through a secondary filter during normal operation of the automotive air-conditioning refrigerant system. Following flushing and filtration operations in the primary circuit, a flow path selection means shifts the flow of refrigerant to the secondary circuit. In one embodiment, a diverter valve is operated to shift the flow of refrigerant to a secondary circuit of the apparatus having a secondary filter. The diverter valve may be manually operated. In another embodiment, an automatic diverter activation means operates to cause such shift in flow. In one embodiment, the differential pressure across the primary filter provides release and actuation of the shifting means. In another embodiment, the excessive system pressure causes release of the shifting means.

Flow through the secondary circuit and secondary filter allows for normal operations of the air-conditioning system. The primary circuit and primary filter are isolated from the flow path of the refrigerant. In one embodiment, the used primary filter is both isolated from the flow path of the refrigerant through the secondary circuit and encapsulated to prevent release of debris from the filter and its container.

This apparatus and method of heated refrigerant flushing avoids the use of flushing solvents while minimizing the use of component parts, labor time and refrigerant.

DESCRIPTION OF THE PREFERRED EMBODIMENTS

One preferred embodiment of the present invention is a post component failure debris filtration apparatus having an isolable first filter for providing filtration of component failure debris and a second filter for providing filtration during normal operation. The present invention also encompasses methods of using the same. The post component failure filtration apparatus for automotive air-conditioning systems combines the advantages of the various above-identified methods for removing debris from air-conditioning systems while eliminating or minimizing the disadvantages of those methods.

Figure 5A:
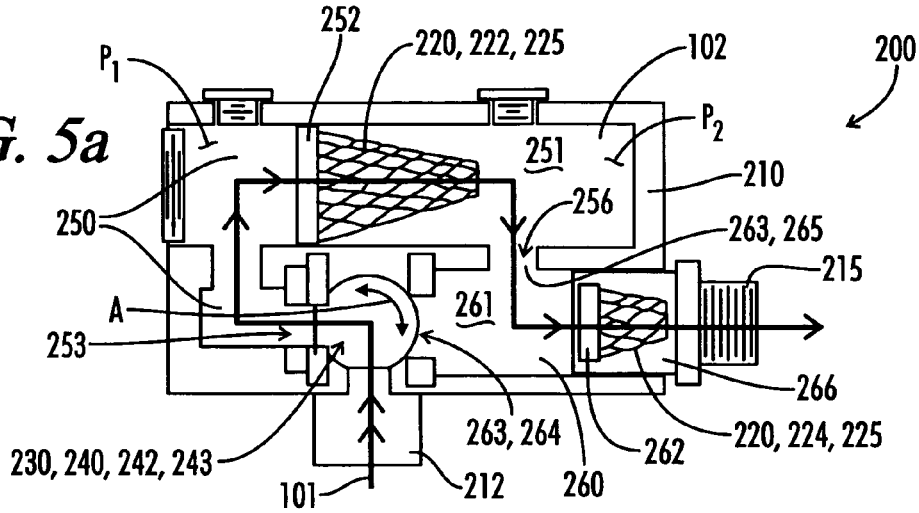
FIGS. 5*a*, 5*b*, and 5*c* show internal component diagrams of one embodiment of the filtration apparatus of this invention.
Figure 5B:
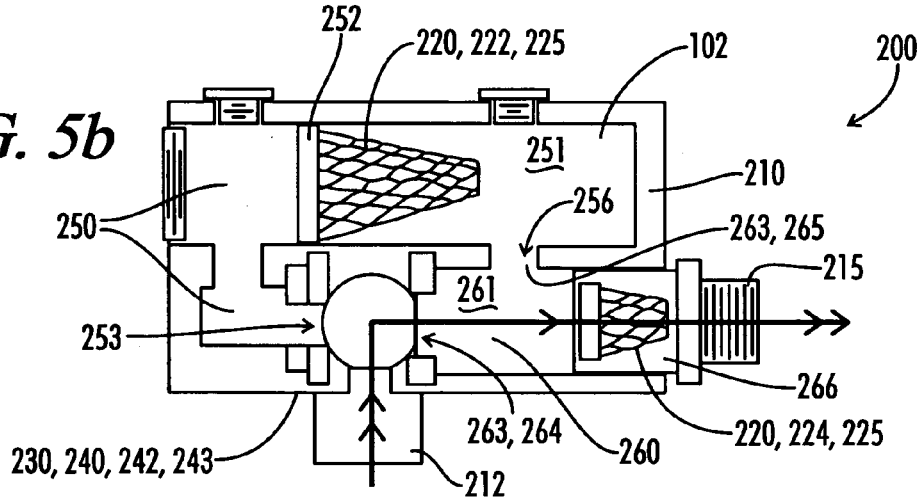
Figure 5C:
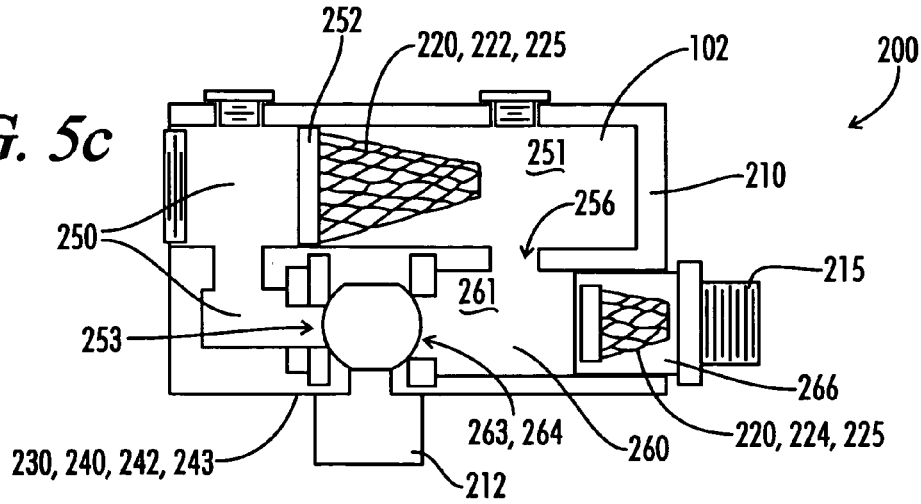

Referring now to FIGS. 5*a*, 5*b* and 5*c*, one embodiment of the invention, filters 220 are disposed in a filtration apparatus 200 as shown. The filtration apparatus 200 includes a filtration housing 210 having a refrigerant inlet port 212 and a refrigerant outlet port 215. Another embodiment (not shown) has a plurality of inlet ports. Yet another embodiment (not shown) has a plurality of outlet ports.

In one embodiment, a flow path selection means 230 is disposed in the filtration housing 210 so as to control the flow path 101 of the refrigerant 102. In one embodiment, the flow path selection means 230 is a diverter valve 240. In the embodiment shown in FIGS. 5*a*, 5*b* and 5*c*, the diverter valve 240 is a ball valve 242 disposed in the filtration housing 210 adjacent to the refrigerant inlet port 212 to control the flow path 101 of the refrigerant 102.

A circuit passage, as used herein, means the channel or series of channels that provide fluid communication between an inlet port and an outlet port. FIGS. 5*a*, 5*b*, and 5*c* show an embodiment having a primary circuit passage 250 and a secondary circuit passage 260 defined within the filtration housing 210. When the diverter valve 240 is positioned to select either circuit, flow through the other circuit is prevented.

The primary circuit passage 250 is shown including a primary filter channel 251 having a primary filter channel inlet 253 and a primary filter channel outlet 256. A primary filter 222 is disposed within the primary filter channel 251 and held in place within the primary filter channel 251 by a primary filter retaining means 252.

FIG. 5*a* shows the diverter valve 240 of one embodiment of the invention disposed so as to direct the flow path 101 of the refrigerant 102 along a primary circuit passage 250. Refrigerant 102 flows from the inlet port 212 and is directed by the diverter valve 240 through the primary filter channel inlet 253 and into the primary filter channel 251. The primary filter 222 is shown disposed within in the primary filter channel 251 such that refrigerant 102 flowing through the primary circuit passage 250 is flowed through the primary filter 222. In the embodiment shown in FIG. 5*a*, the primary filter 222 is a cup filter 225 having about 1.5 inches square filtration surface area, or approximately twice the surface area as a standard orifice filter. In an alternate embodiment of this invention (not shown), the primary filter is a mesh screen filter. In yet another alternate embodiment (not shown), two primary filters are disposed in the primary filter channel and include a screen filter disposed upstream of a cup filter to screen out any large pieces of debris.

FIG. 5*a* further shows the refrigerant 102 flowed from the primary filter 222, through the remainder of the primary filter channel 251 and out the primary filter channel outlet 256. In the embodiment shown in FIG. 5*a*, the refrigerant 102 is further flowed through a secondary filter channel inlet 263, specifically the second secondary filter channel inlet 265, and into the secondary filter channel 261. The flow of the refrigerant 102 along a primary circuit passage 250 is directed through the secondary filter 224 and through the secondary filter channel outlet 266. The refrigerant 102 exits the filtration housing 210 through the outlet port 215. In an alternate embodiment (not shown), the refrigerant is flowed into the secondary filter channel at a secondary filter channel inlet downstream of the secondary filter. In yet other embodiment (also not shown), the filtration housing has multiple outlet ports wherein the refrigerant is flowed from primary filter channel outlet and directly into a outlet port. In this embodiment, the primary circuit passage and the secondary circuit passage do not overlap.

Referring now to FIG. 5*b*, shown is the diverter valve 240 of one embodiment disposed so as to direct the flow of the refrigerant 102 along a secondary circuit passage 260. Refrigerant 102 flows from the inlet port 212 and is directed by the diverter valve 240 through the first secondary filter channel inlet 263, 264 and into the secondary filter channel 261. The secondary filter 224 is shown disposed within in the secondary filter channel 261 such that refrigerant 102 flowing through the secondary circuit passage 260 is flowed through the secondary filter 224. In embodiment shown in FIG. 5*b*, the secondary filter 224 is a cup filter 225 having about 0.75 inches square filtration surface area, or approximately same surface area as a standard orifice filter. In one alternate embodiment, the secondary filter 224 is a cup filter 225 having about 1.5 inches square filtration surface area. In a second alternate embodiment of this invention (not shown), the secondary filter is a mesh screen filter. In yet another alternate embodiment (also not shown), two secondary filters are disposed in the secondary filter channel and include a screen filter disposed upstream of a cup filter to screen out any large pieces of debris.

FIG. 5*b* further shows the refrigerant 102 flowed from the secondary filter 224, through the remainder of the secondary filter channel 261 and out the secondary filter channel outlet 266. In the embodiment shown, primary filter 222 is isolated from direct flow of refrigerant, although the primary filter channel 251 is in fluid communication with the secondary filter channel 261. However, flushing debris is retained in the upstream side of the primary filter 222 and is prevented from entering the secondary filter channel 261.

In one embodiment (not shown) the primary filter includes a primary filter body, preferably of mesh material, defining a primary filter interior region for retaining debris. When the diverter valve is positioned so as to direct flow into the first secondary filter channel inlet it blocks fluid communication through the primary filter channel inlet. This configuration of the apparatus traps debris between the diverter valve and the primary filter body.

In an alternate embodiment of the present invention (not shown), only the primary circuit passage has a filter. The secondary circuit passage is an unfiltered passage. Filtration is provided only during the flushing portion of the operation of the installed filtration apparatus.

FIG. 5*c* shows the diverter valve 240 of one embodiment disposed so as to block the flow of the refrigerant 102 through either circuit passage of the filtration apparatus 200.

Other embodiments of this invention utilize different flow paths that are readily determinable by one skilled in the arts. One embodiment of this invention (not shown) includes an orifice tube disposed in the secondary circuit passage downstream of the secondary filter. This embodiment is useful where the filtration apparatus is used in combination with a replacement refrigerant discharge line where the original orifice tube was integrally incorporated in the original refrigerant discharge line. An optional secondary filter including a course mesh screen filter may be incorporated into this embodiment to trap larger debris before it reaches the orifice tube.

This filtration apparatus is useful in repairing a component failure of an automotive air-conditioning refrigerant system, and, in particular, in repairing a catastrophic failure of a compressor or other component that may result in debris being deposited in the high pressure of the refrigerant system, especially debris being deposited in the condenser. The filtration apparatus is installed in the refrigerant system in conjunction with installation of replacement components for any failed components. A preferred method of installing and using the filtration apparatus is in conjunction with the installation of a suction filter located as close as possible to the compressor suction port.

Figure 1:
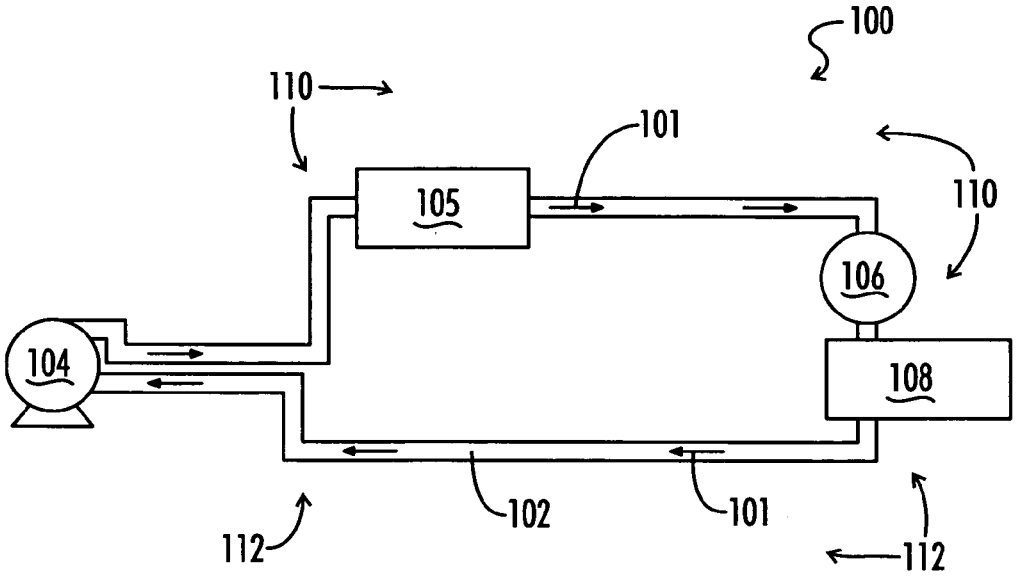
FIG. 1 (PRIOR ART)
FIG. 1 is a refrigerant flow diagram showing the major components of a conventional automotive air-conditioning system and the normal flow of refrigerant.
Figure 2:
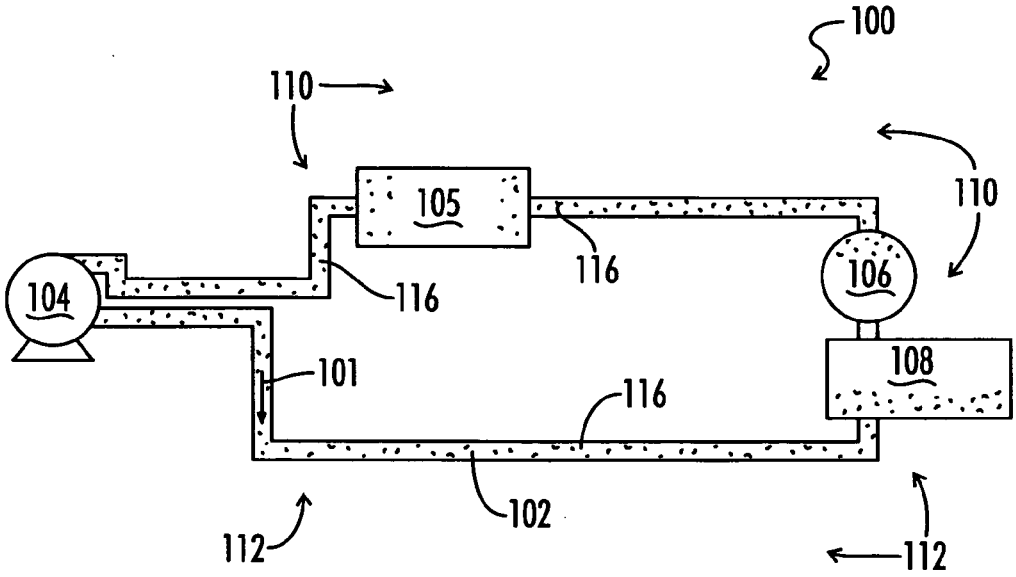
FIG. 2 (PRIOR ART)
FIG. 2 is the refrigerant flow diagram of FIG. 1 showing the reverse flow of refrigerant following a catastrophic compressor failure.
Figure 3:
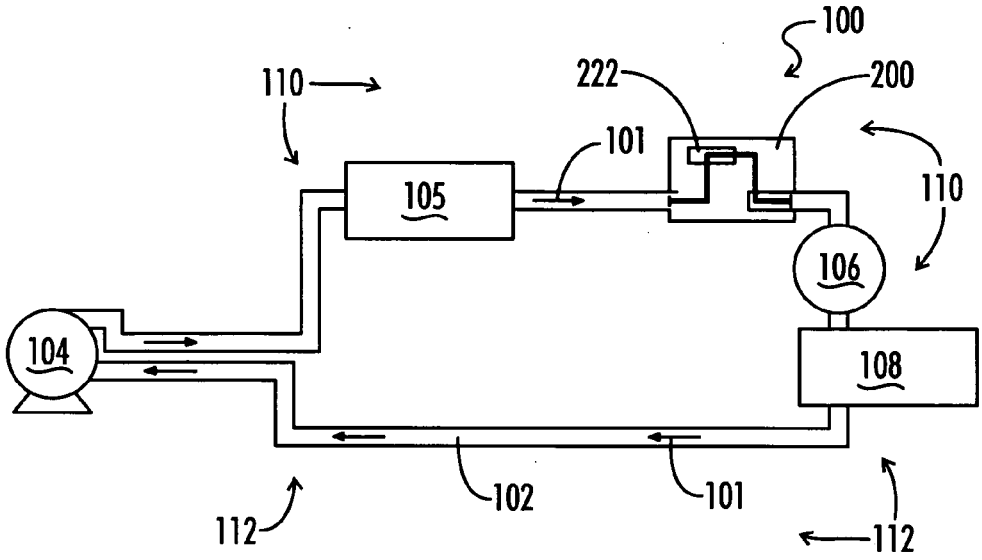
FIG. 3 is the refrigerant flow diagram of FIG. 1 showing the filtration apparatus of this invention installed in the high pressure side after the condenser and showing refrigerant flow through the primary filter.

Referring now to FIGS. 3 and 5*a*, the filtration apparatus 200 is shown installed in the refrigerant system of a repaired air-conditioning refrigerant system 100, including a compressor 104, a condenser 105, an orifice tube 106 and an evaporator 108. In a preferred method, replacement component(s) are installed in an air-conditioning refrigerant system 100 as necessary. Next, a portion of the high-pressure side 110 of an air-conditioning refrigerant system 100 is disassembled or partially disassembled as necessary. The filtration apparatus 200 is disposed in the high-pressure side 110, preferably downstream of the condenser 105. Optionally, a compressor discharge suction filter is disposed in the low-pressure side 112, optimally near the compressor discharge suction. The air-conditioning refrigerant system 100 is reassembled so that refrigerant will flow through the filtration apparatus 200 when the air-conditioning refrigerant system 100 is operated. Refrigerant 102 is charged into the air-conditioning refrigerant system 100 as necessary for proper operation.

With the flow path selection means 230 selected to direct refrigerant 10 flow path 101 to the primary circuit passage 250, the air-conditioning refrigeration system 100 is operated until a shifting parameter is reached. In a preferred method, the air-conditioning refrigeration system 100 is operated for a sufficient time for the refrigerant system 100 to reach normal operating temperatures. The air-conditioning refrigeration system 100 is then operated for a sufficient time for the hot refrigerant to dissolve any debris embedded in the condenser 105. Any such dissolved debris and any other debris deposited on the high pressure side 110 is then trapped by the primary filter 222. Experience has shown that this process of flushing refrigerant 102 through the primary filter 222 requires between about fifteen minutes and about three hours of operating the air-conditioning refrigerant system 100 after reaching normal operating temperatures. More preferably, the process requires about one hour of operating the air-conditioning refrigerant system 100 after reaching normal operating temperatures. This step meets the recommended requirements of a hot flush of post component failure debris from the air-conditioning refrigerant system 100.

Figure 4:
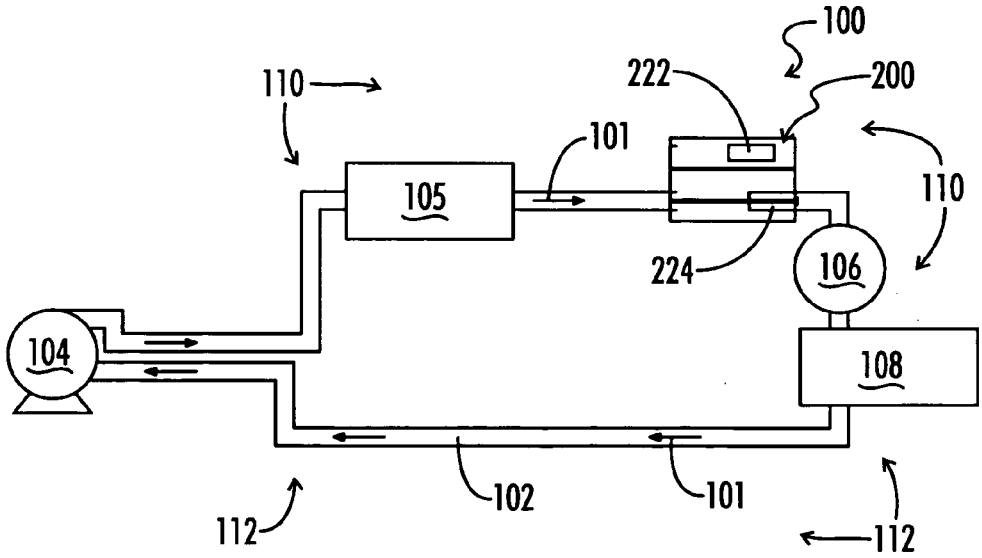
FIG. 4 is the refrigerant flow diagram of FIG. 3 showing refrigerant flow through the secondary filter.

Once debris is removed from the refrigerant 102 and the air-conditioning refrigerant system 100 by the primary filter 222 and, optionally, the compressor suction filter, the flow path selection means 230 is operated to direct refrigerant 102 flow into the secondary circuit passage 260, as shown in FIGS. 4 and 5*b*. The refrigerant 102 is now flowed through the secondary circuit passage 260 and the secondary filter 224. The secondary filter 224 is now essentially unburdened with filtered debris and the refrigerant 102 has been filtered of post component failure debris. The primary filter 222 and the post component failure debris trapped therein are now isolated from the refrigerant flow path 101 through air-conditioning refrigerant system 100. The air-conditioning refrigerant system 100 can now be operated normally without further system repair.

In the method described above, the shifting parameter is elapsed time of operation of the air-conditioning refrigerant system 100 at normal operation temperatures, preferably about one hour of elapsed time of time of operation of the air-conditioning refrigerant system 100 at normal operation temperatures. In an alternate method the shifting parameter of this step is total elapsed time of operation of the air-conditioning refrigerant system 100, preferably between about one half hour and about four hours of elapsed time of time of operation of the air-conditioning refrigerant system 100, and more preferably about one hour of elapsed time of time of operation of the air-conditioning refrigerant system 100.

In another alternate method the shifting parameter of this step is differential pressure across the primary filter 222. In one embodiment of the apparatus of the invention for practicing this alternate method, the filtration housing 200 shown in FIGS. 5*a*, 5*b*, and 5*c* further includes an automatic diverter means (not shown) for sensing the differential pressure across the primary filter 222. In this embodiment, the automatic diverter means includes piezoelectric sensors $P_1$, $P_2$ disposed within the primary circuit passage 250 so as to measure the differential pressure across the primary filter 222. The piezoelectric sensors are in electronic communication with an electronic activation means for operating a diverter valve 240 such as a ball valve 242.

In yet another alternate method, the shifting parameter of this step is a significant increase of the compressor discharge pressure during flushing operations indicating a corresponding significant increase in the unmeasured differential pressure across the primary filter 222. In this method a removable pressure gauge (not shown) is attached to the refrigerant charging port (not shown) of the high pressure side 110, typically the refrigerant charging port is collocated with the compressor discharge port. The air-conditioning refrigerant system 100 is operated and the system pressure is monitored. When a significant increase of the compressor discharge pressure above the observed compressor discharge pressure is observed, the shifting parameter is reached and the flow path selection means 230 is operated to direct refrigerant flow path 101 into the secondary circuit passage 260. In one embodiment, the shifting parameter is between about 5 p.s.i.g. and about 20 p.s.i.g. and, more preferably, the shifting parameter is about 8 p.s.i.g.

In one embodiment of the filtration apparatus 200 and method of using the same shown in FIGS. 5*a*, 5*b*, and 5*c*, the flow path selection means 230 is a diverter valve 240, specifically a manual diverter means 243 such as a manual ball valve 242. A manual diverter means 243 or any other suitable manual flow path selection means 230 requires additional labor cost and labor time to monitor the operation of the air-conditioning refrigerant system for extended periods of time beyond the base time to repair the system and to install the filtration apparatus 200. It is desirable to automate the flushing operation and the subsequent shifting of the flow path selection means 230. This could euphemistically be termed a 'fix and forget' feature. Additionally, it would be desirable to house the primary filter in an isolable container that would isolate the air-conditioning refrigerant system from the primary filter 222 after the flushing operation while encapsulating the primary filter 222 within the filtration housing 210.

One preferred embodiment of the present invention is a post component failure debris filtration apparatus having a first filter for providing filtration of component failure debris and a second filter for providing filtration during normal operation. A differential pressure mechanism automatically shifts the flow selection means so as to isolate the first filter and provide flow though the second filter when the differential pressure across the first filter reaches a preset value. One embodiment provides for isolating the first filter by at least partial encapsulation. The present invention also encompasses methods of using the filtration apparatus. In this preferred embodiment, the differential pressure across the first filter causes a container housing the first filter to reposition so as to isolate and seal the first filter and the post component failure debris contained within the first filter.

Figure 6A:
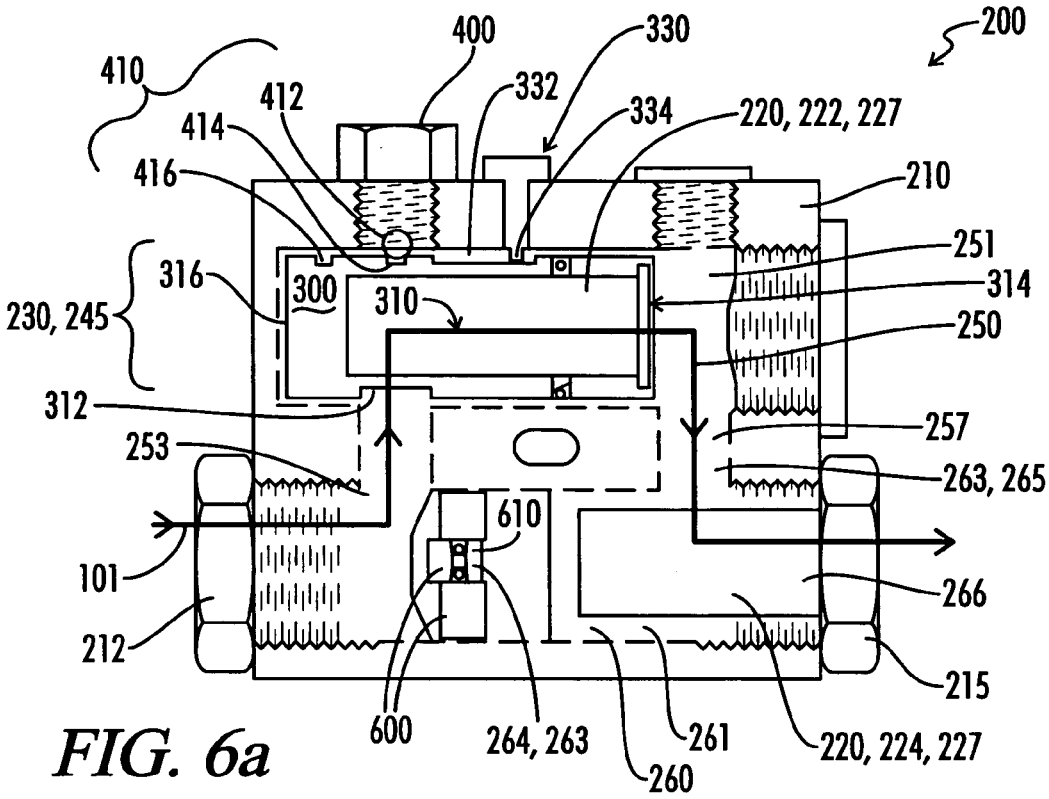
FIGS. 6*a* and 6*b* show internal component diagrams of a second embodiment of the filtration apparatus of this invention.
Figure 6B:
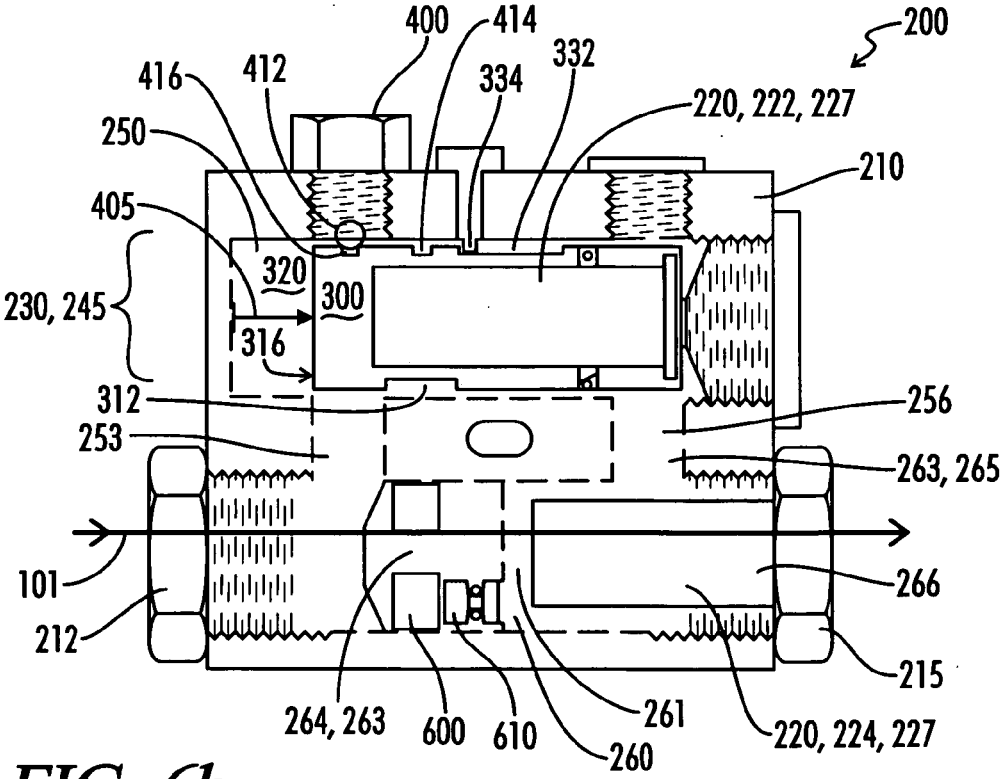

Referring now to FIGS. 6*a* and 6*b*, one preferred embodiment of the filtration apparatus 200 is shown. The filtration apparatus 200 includes a filtration housing 210 having a refrigerant inlet port 212 and a refrigerant outlet port 215. Another embodiment (not shown) has a plurality of inlet ports. Yet another embodiment (not shown) has a plurality of outlet ports. The filtration housing 210 is further shown having a primary circuit passage 250 and a secondary circuit passage 260 defined within the filtration housing 210.

Figure 7:
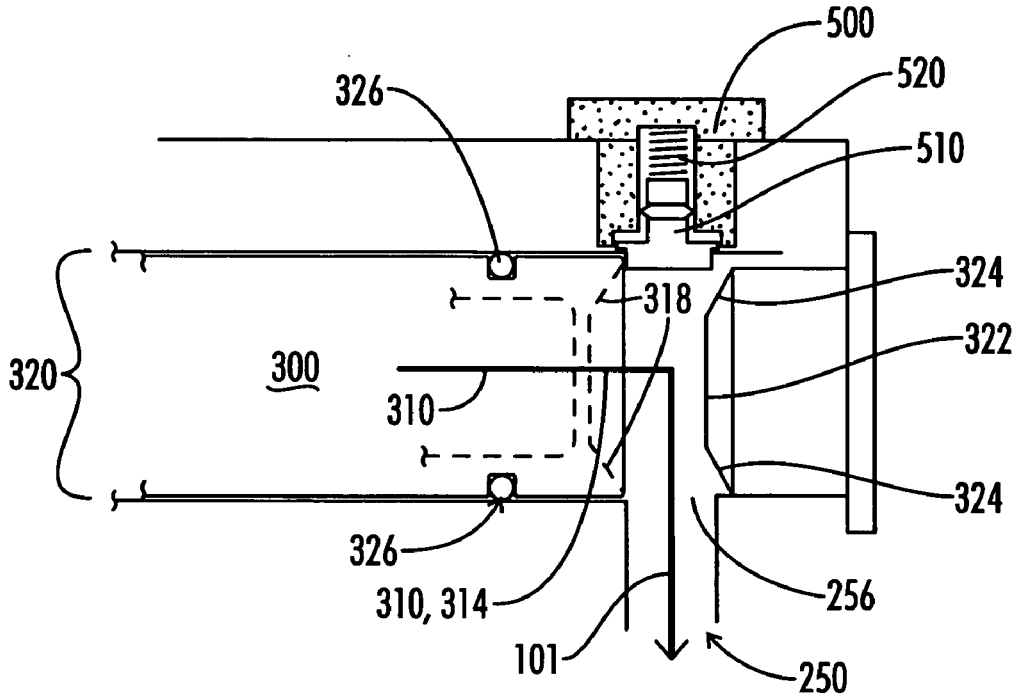
FIG. 7 and FIG. 8 show internal component diagrams details of optional features of the embodiment of FIGS. 6*a* and 6*b*.

FIG. 6*a* shows the flow path 101 refrigerant through a primary circuit passage 250, including through a primary filter channel 251 having a primary filter channel inlet 253 and a primary filter channel outlet 256. Referring to FIGS. 6*a* and 7, the primary filter channel 251 shown includes a housing piston cylinder 320. The housing piston cylinder 320 includes a piston cap 322, a piston cap seat 324 and piston cylinder pressure sealing means 326. Referring to FIGS. 6*a* and 7, a housing piston 300 is disposed within the housing piston cylinder 320 and is shown having a piston interior channel 310, a piston interior channel inlet 312, a piston interior channel outlet 314, a piston face 316 and a piston outlet seat 318. A primary filter 222 is disposed within housing piston 300.

A flow path selection means 230 is disposed in the filtration housing 210 so as to selectively direct the flow path 101 of the refrigerant along a circuit passage. In one embodiment, the flow path selection means 230 is an automatic diverter means 245 including a releasable housing piston 300, a differential pressure activation means 400 and a blow out assembly 600. In this embodiment, with filtration apparatus 200 configured such that the refrigerant flow path 101 is initially directed along the primary circuit passage 250, the differential pressure activation means 400 prevents movement of the housing piston 300 until the differential pressure across the primary filter 222 exceeds a predetermined value. Once the differential pressure activation means 400 is activated by such differential pressure across the primary filter 222, it releases the housing piston 300 for movement within housing piston cylinder 320.

FIG. 6*a* shows the flow path selection means 230 of one embodiment disposed so as to direct the flow path 101 of the refrigerant along a primary circuit passage 250. Refrigerant flows from the inlet port 212 and through primary filter channel inlet 253. Flow through the first secondary filter channel inlet 263, 264 is blocked by a blow out assembly 600 including blow out plug 610.

FIG. 6*a* shows the housing piston 300 aligned and positioned so that refrigerant flows from the primary filter channel inlet 253 through the piston interior channel inlet 312 and into in the piston interior channel 310. The refrigerant is then flowed through the primary filter 222.

In the embodiment shown in FIG. 6*a*, the primary filter 222 is a cartridge filter 227. In an alternate embodiment of this invention (not shown), the primary filter is cup filter having about 1.5 inches square filtration surface area, or approximately twice the surface area as a standard orifice filter. In yet another alternate embodiment (not shown) two primary filters are disposed in the primary filter channel and include a cup filter and a screen filter disposed upstream of the cup filter to screen out any large pieces of debris.

FIG. 6*a* further shows the refrigerant flowed along the flow path 101 from the primary filter 222, through the remainder of the piston interior channel 310 and out the piston interior channel outlet 314. The refrigerant is then flowed along the remainder of the primary filter channel 251 and out the primary filter channel outlet 256. In the embodiment shown, the refrigerant is further flowed through a second secondary filter channel inlet and into the secondary filter channel 261. The flow path 101 of the refrigerant along a primary circuit passage 250 is directed through the secondary filter 224 and through the secondary filter channel outlet 266. The refrigerant 102 exits the filtration housing 210 through the outlet port 215. In an alternate embodiment (not shown) the refrigerant is flowed into the secondary filter channel at a second secondary filter channel inlet downstream of the secondary filter. In yet other embodiment (not shown), the filtration housing has multiple outlet ports wherein the refrigerant is flowed from primary filter channel outlet and directly into an outlet port. In this embodiment, the primary circuit passage and the secondary circuit passage do not overlap.

The housing piston 300 is held in alignment so as to prevent rotation around its axis by housing piston alignment means 330. In one embodiment shown in FIGS. 6*a* and 6*b*, the housing piston alignment means 330 includes a narrow piston alignment channel 332 disposed axially within the side of the housing piston 300 and receiving a piston alignment guide 334. The piston alignment guide 334 prevents rotation of the housing piston 300 around its axis while allowing axial translational movement of the piston within the housing piston cylinder 320.

During flushing and filtering operations of flowing refrigerant through the primary circuit passage 250, a differential pressure activation means 400 maintains the housing piston 300 in the configuration directing refrigerant flow along primary circuit passage 250 until sufficient differential pressure develops across the primary filter 222 as the primary filter 222 filters and retains post component failure debris. In one embodiment the differential pressure activation means 400 includes a spring activated detent release assembly 410. As shown in FIGS. 6*a* and 6*b*, the spring activated detent release assembly 410 includes a spring loaded detent 412, a first detent retaining channel 414 and a second detent retaining channel 416.

In the embodiment shown in FIG. 6*a*, the spring loaded detent 412 is positioned in the first detent retaining channel 414. As the primary filter 222 removes entrained debris, the differential pressure across the primary filter 222 increases. In the embodiment shown, the differential pressure across the primary filter 222 is generally equivalent to the net pressures exerted upon the ends of the housing piston 300 by the refrigerant. Conceptually, the differential pressure can be seen as acting upon the housing piston face 316. In one embodiment, the spring loaded detent 412 and the first detent retaining channel 414 are so configured that a differential pressure across the primary filter of between about 5 p.s.i.g. and about 20 p.s.i.g. will cause the spring loaded detent 412 to unseat from the first detent retaining channel 414. More preferably, a differential pressure across the primary filter of about 8 p.s.i.g. will cause the spring loaded detent 412 to unseat from the first detent retaining channel 414.

The differential pressure acting on the housing piston face 316 will cause the unseated housing piston 300 to move within the housing piston cylinder so as to redirect flow of refrigerant to the secondary circuit passage 260. FIGS. 6*b* and 7 shows a conceptualized differential pressure line of force 405 acting on the housing piston face 316 and forcing the housing piston 300 to move along the housing piston cylinder 320 until the spring loaded detent 412 to seats in the second detent retaining channel 416. The second detent retaining channel 416 is sized and shaped so as to permanently retain the spring loaded detent 412.

With the spring loaded detent 412 permanently seated in the second detent retaining channel 416, the housing piston outlet seat 318 is forced against the piston cap seat 324. In this configuration, the piston interior channel inlet 312 and the piston interior channel 310 are blocked and refrigerant flow through the primary circuit passage 250 is prevented. This configuration also isolates the primary filter 222 from the flow of the refrigerant and encapsulates the primary filter 222 within the housing piston 300 so that all fluid communication with the primary filter is interrupted. Thus, the primary filter 222 and all post component failure debris is retained within the filtration housing 210 but completely isolated from the refrigerant.

Once the refrigerant flow along the primary circuit passage 250 is blocked, refrigerant pressure at the inlet port 212 increases toward maximum compressor discharge pressure. At a predetermined pressure less that maximum compressor discharge pressure, the blow out assembly 600 blocking the first secondary filter channel inlet 264 releases and opens a flow path 101 to the secondary filter channel 261. In one embodiment, the blow out assembly 600 includes a blow out plug 610. In an alternate embodiment (not shown), the blow out assembly includes a rupture membrane.

FIG. 6*b* shows the blow out plug 610 of one embodiment pushed out of the first secondary filter channel inlet 263, 264 so as to direct the flow path 101 of the refrigerant along a secondary circuit passage 260. The blow out plug 610 is shown retained within the secondary filter channel 261. In this embodiment, refrigerant flows from the inlet port 212 through the first secondary filter channel inlet 263, 264 and into the secondary filter channel 261. The secondary filter 224 is shown disposed within in the secondary filter channel 261 such that refrigerant 102 flowing through the secondary circuit passage 260 is flowed through the secondary filter 224. In embodiment shown in FIG. 6*b*, the secondary filter 224 is a cartridge filter 227. In one alternate embodiment (not shown), the secondary filter is a cup filter having about 0.75 inches square filtration surface area, or approximately same surface area as a standard orifice filter. In a second alternate embodiment of this invention (not shown), the secondary filter is a mesh screen filter. In yet another alternate embodiment (not shown), two secondary filters are disposed in the secondary filter channel and include a screen filter disposed upstream of a cup filter to screen out any large pieces of debris. FIG. 6*b* further shows the refrigerant flowed from the secondary filter 224, through the remainder of the secondary filter channel 261 and out the secondary filter channel outlet 266.

Figure 8:
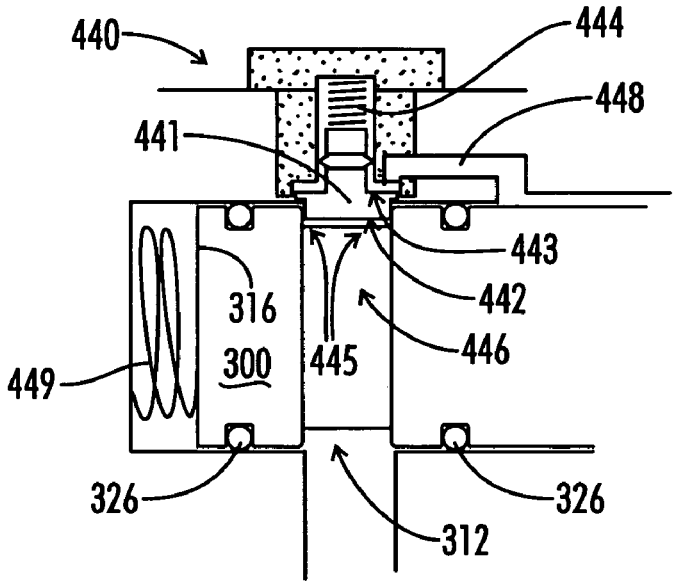

FIG. 8 shows an alternate embodiment having a differential pressure release assembly 440 in place of the spring activated detent release assembly. The differential pressure release assembly 440 includes a differential pressure piston 441 having a high pressure face 442, a low pressure face 443 and a biasing spring 444. The differential pressure piston 441 is shown seated within retaining channel 445 and blocking movement of the housing piston 300. A high pressure port 446 routes refrigerant from the piston interior channel inlet 312 to the high pressure face 442 and a low pressure port 448 routes refrigerant from the piston interior channel outlet 314 to the low pressure face 443.

At a preset differential pressure across the primary filter the force of the pressure at the high pressure face 442 overcomes the combined forces of the pressure at the low pressure face 443 and the force of the biasing spring 444. At this preset differential pressure the differential pressure piston 441 lifts and releases the housing piston 300. The flow path selection means 230 operates as described above.

In one embodiment, the differential pressure piston 441 is so configured that a differential pressure across the primary filter of between about 5 p.s.i.g. and about 20 p.s.i.g. will cause the differential pressure piston 441 to unseat from the retaining channel 445. More preferably, a differential pressure across the primary filter of about 8 p.s.i.g. will cause the differential pressure piston 441 to unseat from the retaining channel 445.

Once the differential pressure piston 441 is unseated, activation spring 449 acting on the housing piston face 316 forces the housing piston 300 through the housing piston cylinder 320 so as to isolate the primary filter 222. This alternative embodiment ensures that there is sufficient motive force to rapidly isolate and seal the primary filter 222 within the housing cylinder 300. This alternative embodiment is advantageous where low differential pressures for activation are desired.

Referring now to FIG. 7, an alternative embodiment is shown having a system pressure sensing release assembly 500 which serves to retain the housing cylinder 300 in a configuration for refrigerant flow though the primary circuit passage 250 until the filtration assembly is installed within an air-conditioning refrigerant system. The system pressure sensing release assembly 500 includes a system pressure piston 510 and a system pressure biasing spring 520. Once the system pressure of the air-conditioning refrigerant system exceeds a preset value, the force on the system pressure piston 510 overcomes the force exerted by the system pressure biasing spring 520 and the system pressure piston 510 releases the housing cylinder 300 for normal operation of the filtration apparatus. In one embodiment (not shown), the system pressure piston has a ratcheting system that prevents the system pressure piston from reseating. Alternate embodiments (not shown) substitute a manually removable retaining screw or tab for the system pressure sensing release assembly. This requires the user to manually replace with retaining screw with a plug prior to installing the filtration apparatus.

This filtration apparatus and method of flushing post component failure debris from the refrigerant system has the advantages of:

(1) requiring only the replacement of failed components and avoiding the replacement of otherwise functional components that may be contaminated with debris;

(2) avoiding entirely the use of flushing solvents and any potential subsequent damage to the compressor caused by potential dilution of refrigerant oil;

(3) requiring only a single charging volume of refrigerant to be used;

(4) heating the condenser 105 sufficiently to dissolve any embedded debris;

(5) providing an inline filter to trap debris not removed by flushing;

(6) avoiding filter replacement following debris flushing;

(7) ensuring that the orifice tube or expansion valve remains as clean as possible; and, optionally, (8) installing a suction filter to trap debris in the low pressure side of the air-conditioning refrigerant system.

Alternative embodiments of this invention are readily apparent to one skilled in the art. One embodiment (not shown) allows for pressure isolation as well as flow isolation of the primary filter. This allows for replacement of the primary filter and repetition of flushing operations. Similarly, multiple independent and separably isolable primary circuit passages may be incorporated in an embodiment of the invention. Additionally, multiple independent and separably isolable secondary circuit passages may be incorporated in an embodiment of the invention. Primary and secondary circuit passages may have multiple filters.

Thus, although there have been described particular embodiments of the present invention of a new and useful Post Component Failure Filtration Apparatus for Automotive Air-Conditioning Systems, it is not intended that such references be construed as limitations upon the scope of this invention except as set forth in the following claims.

What is claimed is:

1. A method of filtering entrained debris from the refrigerant of a refrigerant system, the method comprising the steps of:

(a) providing a refrigerant system comprising a high pressure side including a compressor, a condenser and a flow reducing device;

(b) providing a refrigerant filtration apparatus comprising:

a filtration housing having an inlet port and an outlet port, each port adapted for connection to a refrigerant system;

a primary circuit passage defined in the filtration housing and selectably providing fluid communication between the inlet port and the outlet port, the primary circuit passage comprising:

a primary filter channel; and a primary filter disposed in the primary filter channel and adapted to filter debris from refrigerant flowed through the primary filter channel;

a secondary circuit passage defined in the filtration housing and selectably fluid providing communication between the inlet port and the outlet port, the secondary circuit passage comprising:

a secondary filter channel; and a diverter means disposed within the filtration housing and operably adapted to selectively direct refrigerant flow through either the primary circuit passage or the secondary circuit passage;

(c) installing the refrigerant filtration apparatus in the refrigerant system high pressure side;

(d) operating the diverter means so as to direct refrigerant flow to the primary circuit passage;

(e) operating the refrigerant system until a shifting parameter is obtained; and (f) operating the diverter means so as to direct refrigerant flow to the secondary circuit passage.

2. The method of claim 1, wherein, the secondary circuit passage comprising of step (a) further comprises a secondary filter disposed in the secondary filter channel and adapted to filter debris from refrigerant flowed through the secondary filter channel.

3. The method of claim 1, wherein step (c) further comprises installing the refrigerant filtration apparatus downstream of the condenser.

4. The method of claim 1, wherein the shifting parameter comprises a selected elapsed time of operation of the refrigerant system after reaching normal operating temperatures, and wherein step (e) further comprises:

operating the refrigerant system for a sufficient time for the refrigerant system to reach normal operating temperatures; and operating the refrigerant system for said selected elapsed time of operation after reaching normal operating temperatures.

5. The method of claim 4, wherein said refrigerant system comprises an air conditioning refrigerant system, and wherein, said selected elapsed time of operation comprises an elapsed time of operation of between about fifteen minutes and about three hours after reaching normal operating temperatures.

6. The method of claim 5, wherein, said selected elapsed time of operation comprises an elapsed time of operation of about one hour after reaching normal operating temperatures.

7. The method of claim 1, wherein the shifting parameter comprises a selected total elapsed time of operation of the refrigerant system, and wherein step (e) further comprises operating the refrigerant system for said selected total elapsed time of operation.

8. The method of claim 7, wherein said refrigerant system comprises an air conditioning refrigerant system, and wherein, said selected total elapsed time of operation comprises an total elapsed time of operation of between about thirty minutes and about four hours.

9. The method of claim 1, wherein the shifting parameter comprises a selected differential pressure across the primary filter, and wherein step (e) further comprises operating the air-conditioning refrigerant system until said selected differential pressure across the primary filter is obtained.

10. The method of claim 9, wherein, said selected differential pressure across the primary filter comprises a differential pressure across the primary filter of between about 5 p.s.i.g. and about 20 p.s.i.g.

11. The method of claim 10, wherein, said selected differential pressure across the primary filter comprises a differential pressure across the primary filter of about 8 p.s.i.g.

12. The method of claim 9, wherein, diverter means is adapted to sense the differential pressure across the primary filter.

13. The method of claim 9, wherein said diverter means comprises:

a diverter valve;

piezoelectric sensors disposed within the primary circuit passage and adapted to measure the differential pressure across the primary filter; and an electronic activation means in electronic communication with the piezoelectric sensors and adapted to operate said diverter valve.

14. The method of claim 1, wherein said compressor has a normal compressor discharge pressure, wherein, the shifting parameter comprises a selected compressor discharge pressure above said normal compressor discharge pressure, and wherein step (e) further comprises operating the air-conditioning refrigerant system until said selected compressor discharge pressure above said normal compressor discharge pressure is obtained.

15. The method of claim 14, wherein, said selected compressor discharge pressure above said normal compressor discharge pressure comprises a compressor discharge pressure of between about 5 p.s.i.g. and about 20 p.s.i.g. above said normal compressor discharge pressure.

16. The method of claim 15, wherein, said selected compressor discharge pressure above said normal compressor discharge pressure comprises a compressor discharge pressure of about 8 p.s.i.g. above said normal compressor discharge pressure.

* * * * *